United States Patent [19]

Eddy

[11] 4,368,841

[45] Jan. 18, 1983

[54] PAPER CONTAINER

[75] Inventor: William Eddy, Kansas City, Mo.

[73] Assignee: Phillips Petroleum Company, Bartlesville, Okla.

[21] Appl. No.: 175,980

[22] Filed: Aug. 7, 1980

[51] Int. Cl.[3] ..... B65D 8/08; B65D 3/28

[52] U.S. Cl. ..... 229/5.5; 229/1.5 B; 220/74

[58] Field of Search ..... 229/5.5, 5.8, 1.5 B; 220/67, 74

[56] References Cited

U.S. PATENT DOCUMENTS

| | | | |
|---|---|---|---|
| 1,056,675 | 3/1913 | Hill | 229/5.5 |
| 2,158,118 | 5/1939 | Gullion | 229/5.5 |
| 2,661,137 | 12/1953 | Reid . | |
| 2,772,043 | 11/1956 | Foord . | |
| 2,801,946 | 8/1957 | Evenblij | 229/5.5 |
| 2,979,224 | 4/1961 | Henchert | 220/67 |
| 3,001,666 | 9/1961 | Caproni | 220/67 |

FOREIGN PATENT DOCUMENTS

| | | | |
|---|---|---|---|
| 728986 | 4/1955 | United Kingdom | 229/5.5 |
| 848210 | 9/1960 | United Kingdom . | |

*Primary Examiner*—Herbert F. Ross

[57] ABSTRACT

A container comprising a generally circular or frustoconical tubular paperboard sidewall having a closed bottom wherein the upper end of said sidewall has been folded outwardly and downwardly then upwardly back upon itself so as to form a rim of three thicknesses of said sidewall paperboard surrounding the upper end of the container.

4 Claims, 4 Drawing Figures

PAPER CONTAINER

This invention relates to the art of paper container manufacture. In one aspect, this invention relates paper containers having a novel rim structure.

There are numerous types of containers known in the art which have sidewalls of generally cylindrical or frustoconical tubes formed from flat paperboard blanks or spirally wound paperboard. For containers of larger diameter, it has been recognized as generally necessary to provide some sort of reinforcement on the ends of the tubes in order to insure that the containers will have structural integrity.

One approach that has been taken has involved the use of metal rings which are placed over the ends of the tube. Such a technique has been used in large containers sold as Bulkan ® and Chipkan ® containers, products of Sealright Co., Inc., Kansas City, Mo. and in containers shipped collapsed to be formed by customers in their plants.

An object of the present invention is to provide a means for eliminating the need for metal rings on such containers.

Another object of the present invention is to provide a novel integral paperboard rim on the sidewall which is capable of providing integrity for the container and which is capable of cooperating with a paperboard closure to provide a seal tight fit between said closure and said rim.

Other aspects, objects, and advantages of the present invention will be apparent from the following description, the appended drawings and the claims.

SUMMARY OF THE INVENTION

In accordance with the present invention, there is provided a container comprising a generally circular or frustoconical tubular paperboard sidewall having a closed bottom wherein the upper end of said sidewall is folded outwardly and downwardly then upwardly back upon itself so as to form a rim of three thicknesses of paperboard sidewall surrounding the open upper end of said container. In a preferred embodiment, the free edge of the upper end of the sidewall is folded over so that it rests above the innermost portion of the sidewall layer. Also, preferably the container is used in conjunction with a top closure comprising a generally circular end portion surrounded by a downwardly depending flange portion adapted for frictional engagement with the rim of said sidewall.

While the material used for the sidewalls is not considered to be critical, the container features here disclosed provide rigidity for containers in which the sidewall is relatively flexible. For example, the features here disclosed provide rigidity for containers in which the sidewall has flexibility about the same order of magnitude as a similar strip of a single ply of the paperboard base stock generally used in currently produced paperboard cartons. The paperboard base stock generally used in such cartons has a thickness in the range of about 14 mils to about 28 mils and about 3000 square feet of that base stock weighs about 180 to about 360 pounds (i.e., a basis weight of about 180 to about 360 pounds). Cylindrical and conical containers of the present invention having sidewalls of such flexibility are more resistant to having their generally circular cross sections deformed by exterior forces, than are prior art cylindrical and conical containers having sidewalls constructed of similar flexible material. Accordingly, the present invention is particularly useful for the "all-paper" containers, i.e., those in which the sidewalls and any container closures are all constructed of paperboard base stock of the type generally used in making cartons.

The sidewall can be formed of a single thickness of sidewall material or of multiple plys of sidewall material. The sidewall can be formed using any technique known in the art as being suitable for producing tubes. One such technique involves spirally wrapping a strip of sidewall material and severing the resulting wound tubing into the desired lengths. Another technique involves folding a sidewall blank around a mandrel so that one side of one edge margin of said blank is overlapped and secured to the opposite side of the opposite edge margin of said blank.

The present invention is particularly useful for containers formed from sidewall material which has heretofore been used in forming the Bulkan ® and Chipkan ® containers, particularly those for use in making containers having an outside diameter of greater than about 9 inches.

A better understanding of the invention will be provided by referring to the drawings wherein, FIG. 1 is a partial cut-away side view of the upper portion of an inventive container along with a partial cut-away side view of a conforming top closure for use therewith.

Figure 1:
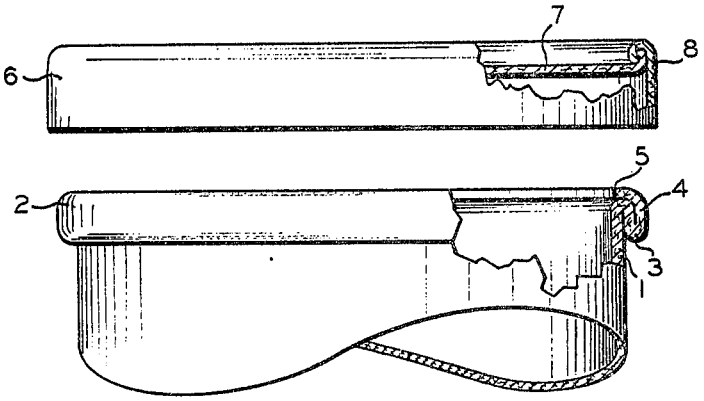

The embodiment of the present invention illustrated in FIG. 1 comprises a tubular generally cylindrical sidewall 1 having an outwardly extending rim 2. The rim 2 is formed by folding a portion 3 of the upper end of the sidewall outwardly and downwardly and then folding an additional portion 4 of the sidewall upwardly back upon portion 3 so as to provide three thicknesses of the sidewall in the area surrounding the upper end of the container. The free edge 5 of the upper end of the sidewall is further folded over so that it rests above the innermost sidewall layer 1.

The closure 6 comprises a generally circular end portion 7 and a downwardly depending skirt portion 8, both 7 and 8 being formed of paperboard. The dimensions of the closure 6 are such that when it is fitted down over the upper end of the container portion, the inner wall of the downwardly depending skirt 8 is in frictional engagement with the outer wall of rim 2.

Figure 2:
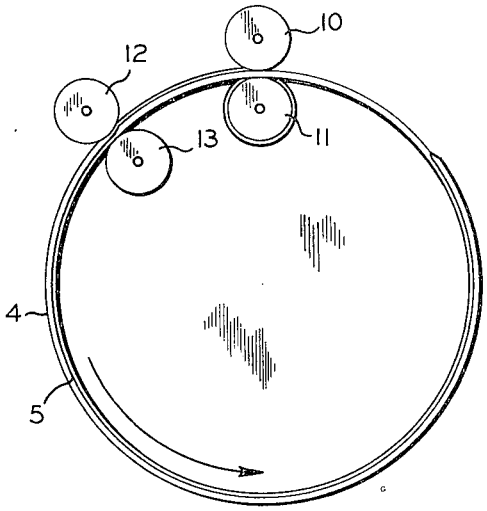
FIG. 2 is an illustration of the operation of forming rolls to form the inventive rim.
Figure 3:
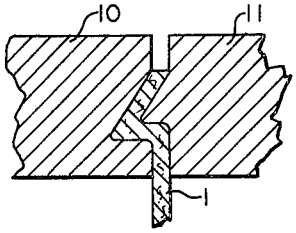
FIG. 3 is a fragmentary cross-sectional view of forming rolls 10 and 11 of FIG. 2.
Figure 4:
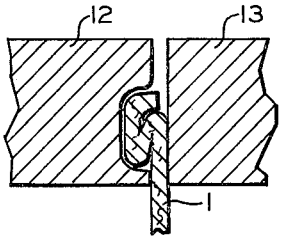
FIG. 4 is a fragmentary cross-sectional view of forming rolls 12 and 13 of FIG. 2.

The rim can readily be formed using techniques well known to those skilled in the art of forming rolled rims on such containers. An example of one such technique is disclosed in FIGS. 2-4. This technique employs the use of two pairs of cooperating forming rollers. As the container sidewall is rotated counter clockwise relative to the center of its diameter, forming rolls 10 and 11 in timed contact act to buckle the sidewall 1 as shown in FIG. 3. The thus buckled sidewall is finished by forming rolls 12 and 13 which press the sidewall into the shape of the described rim 2. Forming rolls 10 and 11 are timed to open after one rim revolution where as forming rolls 12 and 13 may or may not remain in continuous contact with said rim. One or both pair of forming rolls may be heated or unheated to promote adhesive contact between adjacent surfaces of said rim. Upon completion of rim forming, rolls 12 and 13 open to allow can removal and insertion.

It should be noted that the specific examples provided herein are provided solely for the purpose of better illustrating the invention. The invention is clearly subject to other variations and modifications which are considered to be within the scope of this invention.

What is claimed is:

1. A container comprising a generally circular or frustoconical tubular paperboard sidewall having a closed bottom wherein the upper end of said sidewall has been folded outwardly and downwardly and outwardly and then upwardly back upon itself so as to form a rim of three thicknesses of said sidewall paperboard surrounding the open upper end of the container, said free edge of the upper end of the sidewall being folded over so that said free edge rests above in vertical alignment with the innermost portion of the sidewall layer.

2. A container according to claim 1 wherein said tubular paperboard sidewall is formed from spirally wound paperboard stock.

3. A container according to claim 3 closed with a top end closure comprising a generally circular end portion surrounded by a downwardly depending flange portion in frictional engagement with the rim of said sidewall.

4. A container according to claim 1 closed with a top end closure comprising a generally circular end portion surrounded by a downwardly depending skirt portion in frictional engagement with the rim of said container.

* * * * *